US008622019B2

(12) United States Patent
Pei

(10) Patent No.: US 8,622,019 B2
(45) **Date of Patent: *Jan. 7, 2014**

(54) COATING DEVICE

(75) Inventor: Shao-Kai Pei, Taipei Hsien (TW)

(73) Assignee: Hon Hai Precision Co., Ltd., New Taipei (TW)

( * ) Notice: Subject to any disclaimer, the term of this patent is extended or adjusted under 35 U.S.C. 154(b) by 600 days.

This patent is subject to a terminal disclaimer.

(21) Appl. No.: 12/862,725

(22) Filed: Aug. 24, 2010

(65) Prior Publication Data

US 2011/0192346 A1 Aug. 11, 2011

(30) Foreign Application Priority Data

Feb. 9, 2010 (TW) ..... 99103993 A

(51) Int. Cl.
*B05B 3/02* (2006.01)
*B05C 11/02* (2006.01)

(52) U.S. Cl.
USPC ..... 118/323; 118/326; 118/500; 118/52; 118/612

(58) Field of Classification Search
USPC ..... 118/322, 304, 313, 315, 428, 429, 56, 118/612, 13, 19, 300, 323, 326, 500; 239/222–224; 427/240, 430.1; 366/169.1
See application file for complete search history.

(56) References Cited

U.S. PATENT DOCUMENTS 5,219,120 A * 6/1993 Ehrenberg et al. ..... 239/11
8,336,485 B2 * 12/2012 Pei ..... 118/323

FOREIGN PATENT DOCUMENTS

CN 1766163 A 5/2006

* cited by examiner

*Primary Examiner* — Yewebdar Tadesse
(74) *Attorney, Agent, or Firm* — Altis Law Group, Inc.

(57) ABSTRACT

A coating device includes an autoclave and a spray member. The autoclave includes an autoclave body and a cover sealing the autoclave body. The autoclave body defines a plurality of holding grooves in an inner surface thereof for holding substrates. The spray member is positioned on the cover and received in the autoclave body. The spray member defines openings in a side surface thereof. The spray member includes a container and an ultrasonic atomization unit. The container defines a cavity in communication with the openings. The ultrasonic atomization unit is received in the cavity.

9 Claims, 4 Drawing Sheets

COATING DEVICE

BACKGROUND

1. Technical Field

The present disclosure relates to surface treating devices, and particularly, to a coating device.

2. Description of Related Art

Nano-films, such as zinc oxide (ZnO) nanostructures are usually synthesized by different kinds of technologies, such as ultrasonic spray pyrolysis or hydrothermal synthesis. Generally, an ultrasonic spray pyrolysis apparatus is only used in the ultrasonic spray pyrolysis coating process, and an autoclave is only used in the hydrothermal synthesis process. However, when a nano-film needs to be synthesized by both the above-mentioned two processes, workpieces need to be moved from the ultrasonic spray pyrolysis apparatus to the autoclave. This is inconvenient and can cause the workpieces to be contaminated.

Therefore, it is desirable to provide a new coating device, which can overcome the above-mentioned limitations.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail with reference to the drawings.

Figure 1:
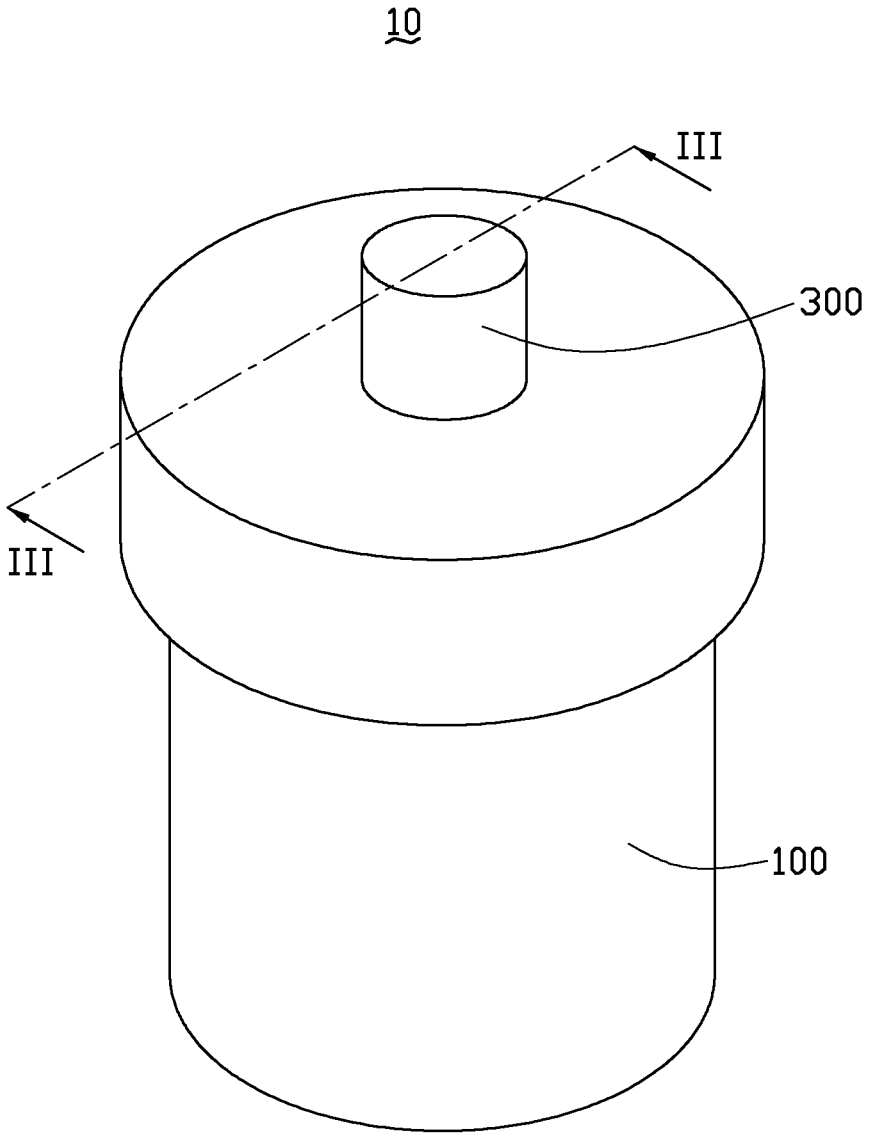
FIG. 1 is an isometric view of a coating device, according to an exemplary embodiment.
Figure 2:
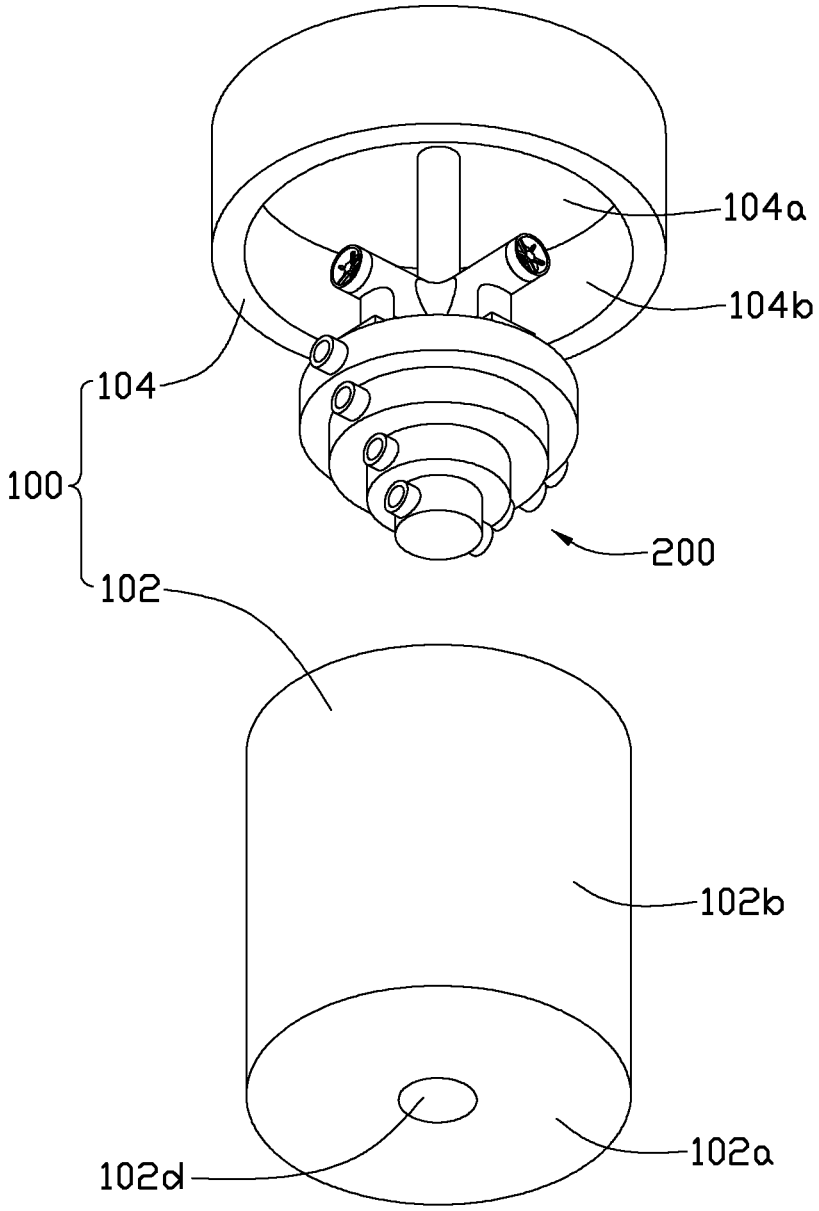
FIG. 2 is a partially exploded view of the coating device of FIG. 1.
Figure 3:
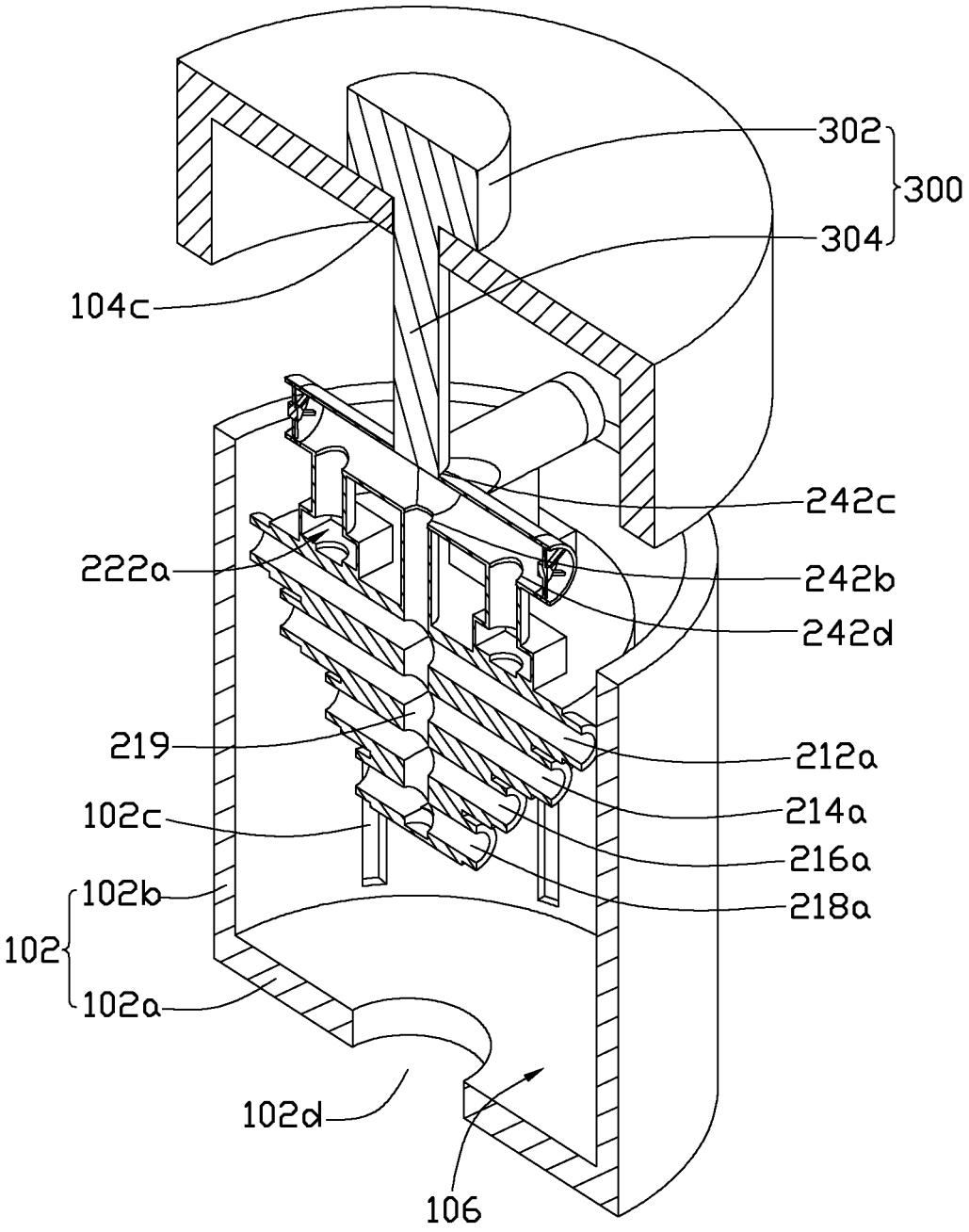
FIG. 3 is a cross-sectional view along the line III-III of FIG. 1.
Figure 4:
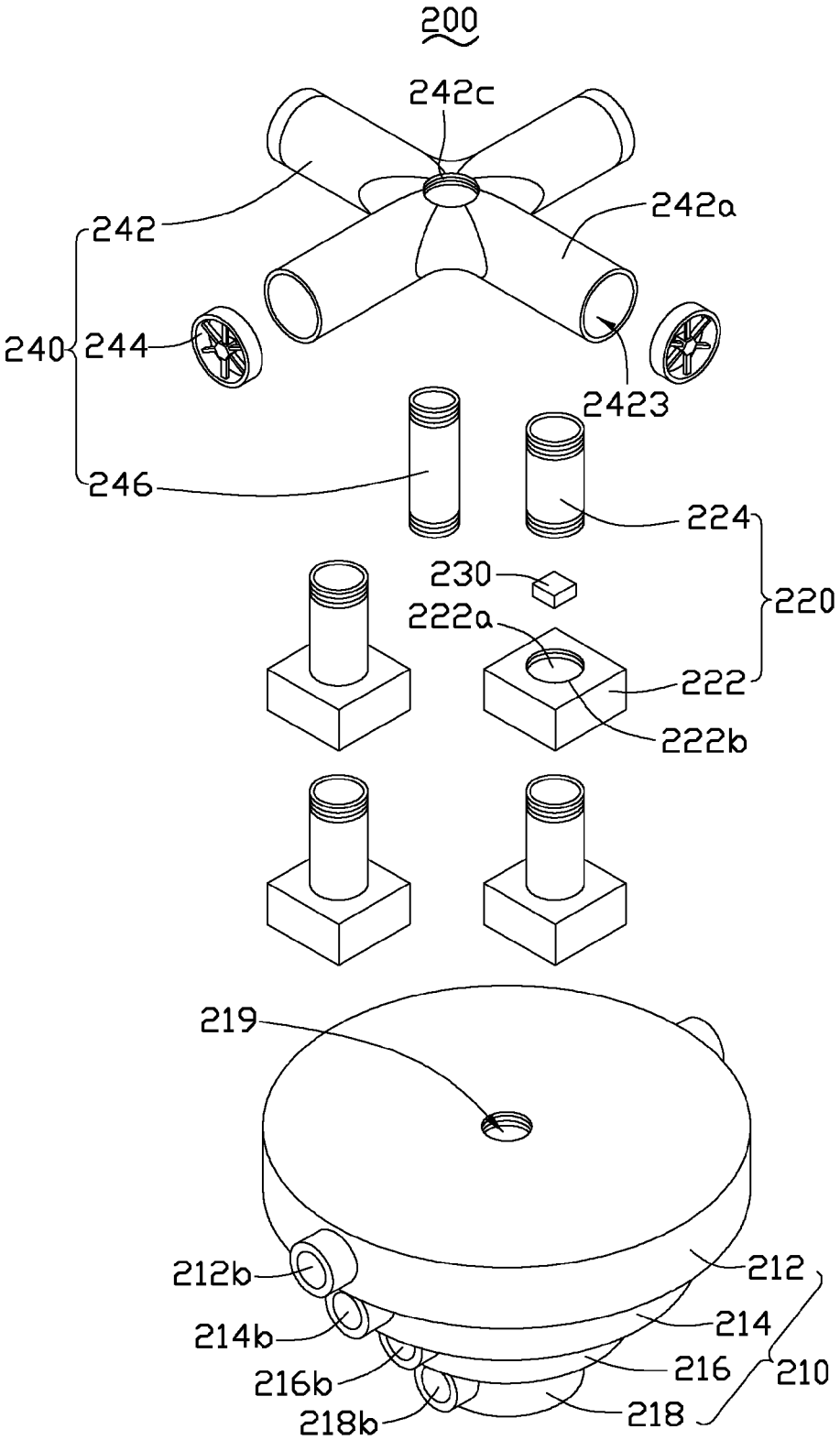
FIG. 4 is an exploded view of a spray member of the coating device of FIG. 1.

Referring to FIGS. 1 to 4, a coating device 10, according to an exemplary embodiment, includes an autoclave 100, a spray member 200, and an actuator 300.

The autoclave 100 includes an autoclave body 102 and a cover 104 covered on the top of the autoclave body 102. The autoclave body 102 includes a bottom plate 102*a* and a first side plate 102*b* extending upwards from the periphery of bottom plate 102*a*. The bottom plate 102*a* defines a feeding opening 102*d*. The feeding opening 102*d* communicates with a solution source (not shown). The inner surface of the first side plate 102*b* defines a number of holding grooves 102*c* configured for fixing a number of substrates (not shown). The first side plate 102*b* is thermally conductively connected to a heat source (not shown), thereby gaining heat from the heat source to heat the substrates and the solution (not shown) in the autoclave 100.

The cover 104 includes a top plate 104*a* and a second side plate 104*b* extending upwards from the periphery of the top plate 104*a*. The top plate 104*a* defines a shaft hole 104*c* at the center thereof. The inner diameter of the cover 104 substantially equals to the outer diameter of the autoclave body 102. When the cover 104 covers the autoclave body 102, the cover 104 substantially seals the autoclave body 102, thereby defining a coating cavity 106 therebetween.

The spray member 200 includes a spray body 210, four containers 220 positioned on the spray body 210, four ultrasonic atomization units 230 received in the four containers 220, and a fan unit 240 engaged with the spray body 210 and the containers 220.

The spray body 210 includes a first plate 212, a second plate 214, a third plate 216, and a fourth plate 218, each of which is cylindrical and stacked on its next plate in turn. The first plate 212 defines a first through hole 212*a* along the radial direction thereof. The first through hole 212*a* defines two first openings 212*b* on the two opposite sides of the first plate 212. The second plate 214, the third plate 216, and the fourth plate 218 each define a through hole therein in a same way as the first though hole 212*a* of the first plate 212, which are respectively indicated as a second through hole 214*a*, a third through hole 216*a*, and a fourth through hole 218*a*. Each of the second through hole 214*a*, the third through hole 216*a*, and the fourth through hole 218*a* defines two openings on two opposite sides of the corresponding plates, which are respectively indicated as a second opening 214*b*, a third opening 216*b*, and a fourth opening 218*b*. The first, second and third openings 212*b*, 214*b*, 216*b* face an inner surface of the autoclave body 102. The spray body 210 also defines a fifth through hole 219 spanning from the first plate 212 to the fourth plate 218 along the center axis thereof. The fifth through hole 219 communicates with the first through hole 212*a*, the second through hole 214*a*, the third through hole 216*a*, and the fourth through hole 218*a*. The fifth through hole 219 is threaded at a terminal portion close to the first plate 212.

The fan unit 240 includes a wind tube 242, four fans 244, and a supporting tube 246. The wind tube 242 includes four cylindrical tubes 242*a* which are joined together and forms a cross portion. Each of the cylindrical tubes 242*a* has an air outlet 2423 at the distal end, communicating with each other. A first connecting threaded hole 242*b* and a second connecting threaded hole 242*c* are defined at the center of two opposite sides of the cross portion. Each of the cylindrical tubes 242*a* defines a third connecting threaded hole 242*d* facing the spray body 210. The supporting tube 246 defines a pair of threaded portions at two ends thereof. Each fan 244 is positioned in the fan opening 2423. Wind is pumped into the wind tube 242 by the fans 244 and flows out from the first connecting threaded hole 242*b*.

The container 220 includes a box 222 and a connecting tube 224. The box 222 defines a cavity 222*a* therein and a fourth connecting thread hole 222*b*. The fourth connecting thread hole 222*b* communicates the cavity 222*a* to the outside of the box 222. Two ends of the connecting tube 224 are mated with the fourth connecting thread hole 222*b* and the third connecting thread hole 242*d*, to communicate the wind tube 242 with the container 220. The ultrasonic atomization units 230 are used for atomizing the solution. Each of the ultrasonic atomization units 230 is positioned in a respective one of the cavities 222*a*.

The actuator 300 includes a motor 302 and a shaft 304 engaged with and driven by the motor 302. The shaft 304 has a threaded end mated with the second connecting thread hole 242*c*. The motor 302 is mounted on the center of the top plate 104*a* of the cover 300, with the shaft 304 extending into the autoclave 100. The shaft 304 passes through the shaft hole 104*c* and screws into the second thread hole 242*c*. As such, the spray member 200 can be driven to rotate by the actuator 300.

In operation, the substrates are positioned in the holding grooves 102*c*. A solution, such as a solution made of $Zn(acac)_2$ and methanol, is injected into each cavity 222*a* of the boxes 222 through the fourth connecting thread holes 222*b*. Then each of the connecting tubes 224 is screwed into the fourth connecting thread holes 222*b* and the third connecting thread hole 242*d*. Therefore, the containers 220 are fixed to the fan unit 240. After that, the supporting tube 246 is screwed into the first connecting thread hole 242*b* and the fifth through hole 219, so that the fan unit 240 is fixed to the spray body 210. The shaft 304 is screwed into the second connecting thread hole 242*c*, so that the spray member 200 is fixed to the actuator 300. Finally the cover 104 covers the autoclave body 102. As such, the spray member 200 is received in the coating cavity 106.

The ultrasonic atomization unit 230 emits an ultrasonic, with a frequency ranging from 2.4 kHz to 15 kHz for example, which atomizes the solution. The atomized solution flows into the wind tube 242 through the connecting tube 224. Meanwhile, the fans 244 pump wind into the wind tube 242. As such, the atomized solution is blown into the coating cavity 106 from those openings or holes 219, 212*a*, 212*b*, 214*a*, 214*b*, 216*a*, 216*b*, 218*a* and 218*b*. The actuator 300 rotates the spray member 200, so that the atomized solution evenly deposits on the surfaces of the substrates. The heat source heats the first side plate 102*b* evenly at very beginning to heat the substrates up to a working temperature, for example about 350 degrees centigrade. In this situation, the atomized solution disposes on the surfaces of the substrates to form a first film thereon. It is known that film formed by spray pyrolysis coating method is relatively more uniform than film formed by hydrothermal coating method, therefore, the first film could be used as a base for forming a second film.

After the first film is formed, the spray member 200 and the actuator 300 stop working. A solution, such as solution made of $Zn(acac)_2$ and methanol is injected into the autoclave 100 from the solution source through the feeding opening 102*d*. The heat source just heats one side of the first side plate 102*b*, so that the solution is heated up to a working temperature, for example about 95 degrees centigrade. As just one side of the first side plate 102*b* is heated, the temperature of the solution near this side would raise faster than the solution at the other side that is opposite to the side being heated. Therefore, a temperature difference occurs between two opposite sides of the solution, which induces convection in the solution. During the convection, the solution is supersaturated, and the solute crystallizes out from the solution and accretes on the first film/seed to grow a second film that is desired, such as ZnO nanostructures.

When using the coating device 10 disclosed in the present embodiment, substrates can be coated by spray pyrolysis coating method and hydrothermal coating method. As such, transferring of substrates between different coating devices is avoided. Therefore, contamination has little chance to enter into the processing chamber to pollute the substrates, thereby improving the coating quality. Meanwhile, as the first film is relatively uniform and can be used as a base, the second film formed based on the first film will be more uniform compared to a film formed without the first film.

The container 220 is configured for forming a cavity 222*a* communicating with the first opening 212*b*, the second opening 214*b*, the third opening 216*b*, and the fourth opening 218*b*, which allows the atomized solution to flow onto the surfaces of substrates. It should be understood that the containers 220 are not limited to this embodiment. In alternative embodiments, different configurations and numbers of container may be utilized.

The actuator 300 is configured for rotating the spray member 200, so that the atomized solution can be sprayed on a number of substrates positioned around the coating cavity 106. It should be understood that in alternative embodiments, when all the substrates could be sprayed with the atomized solution without rotating the spray member 200, the actuator 300 could be omitted.

The fan unit 240 is configured for accelerating the flow of the atomized solution. As the atomized solution will diffuse itself, it should be understood that in alternative embodiments, the fan unit 240 might be omitted. In this condition, the containers 220 may communicate with the spray body 210.

It will be understood that the above particular embodiments is shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. A coating device, comprising:

an autoclave, comprising:

a autoclave body, wherein a plurality of holding grooves is defined in an inner surface of the autoclave body and configured for holding substrates; and a cover sealed the autoclave body; and a spray member positioned on the cover and received in the autoclave body, the spray member defining a plurality of openings in a side surface thereof, the spray member comprising a container and an ultrasonic atomization unit, wherein the container defines a cavity in communication with the plurality of openings, the ultrasonic atomization unit is received in the cavity.

2. The coating device of claim 1, wherein the spray member further comprises a spray body, a plurality of first through holes is defined in the spray body, each first through hole has two of the openings on two opposite sides thereof, a second through hole is defined in the spray body, the second through hole communicates the first through holes to the cavity of the container.

3. The coating device of claim 2, wherein the spray body comprises a plurality of plates, the plates are stacked parallel to each other, each plate defines one of the first through holes, the second through hole extends through the plates.

4. The coating device of claim 3, wherein the openings face the inner surface of the autoclave body.

5. The coating device of claim 3, wherein the container comprises a box and a connecting tube, the box defines the cavity, the connecting tube communicates the cavity to the second through hole.

6. The coating device of claim 5, further comprising a fan unit, wherein the fan unit comprises a wind tube defining a plurality of fan openings and a plurality of fans received in the fan openings, the wind tube communicates the fan openings to the connecting tube and communicates the connecting tube to the second through hole.

7. The coating device of claim 6, wherein the fan unit further comprises a supporting tube, the wind tube comprises four cylindrical tubes, the cylindrical tubes join together and forms a cross portion, the cylindrical tubes communicate with each other, each cylindrical tube defines one of the fan openings at a distal end thereof, a first connecting hole is defined in the cross portion of the cylindrical tubes, a second connecting hole is defined in each cylindrical tube, the supporting tube is received in the first connecting hole and communicates the first connecting opening to the second through hole, the connecting tube is received in the second connecting hole and communicates the second connecting hole to the cavity of the container.

8. The coating device of claim 7, further comprising an actuator, the actuator comprising a motor positioned on the cover and a shaft engaged with the motor, wherein the cover defines a shaft hole; the motor is positioned outside the autoclave body, the shaft passes through the shaft hole and is connected to the cross portion of the cylindrical tubes to drive the spray member and the fan unit to rotate.

9. The coating device of claim 1, wherein the autoclave body defines a feeding opening in the bottom thereof.

* * * * *